United States Patent [19]

Ojanen

[11] Patent Number: 4,547,020

[45] Date of Patent: Oct. 15, 1985

[54] ROTATABLE CUTTING BIT

[75] Inventor: Randall W. Ojanen, Bristol, Va.

[73] Assignee: GTE Products Corporation, Stamford, Conn.

[21] Appl. No.: 492,970

[22] Filed: May 9, 1983

[51] Int. Cl.[4] ..... E21C 9/12

[52] U.S. Cl. ..... 799/86; 175/410

[58] Field of Search ..... 299/86, 79; 175/410; 407/118, 119, 32; 172/717, 713, 747; 76/108, DIG. 11

[56] References Cited

U.S. PATENT DOCUMENTS

| | | | |
|---|---|---|---|
| 3,299,186 | 12/1966 | Buell | 175/410 |
| 3,455,000 | 7/1969 | Flaherty | 407/118 |
| 3,830,321 | 8/1974 | McKenry et al. | 175/335 |
| 3,970,158 | 7/1971 | Black et al. | 175/410 |
| 4,176,725 | 12/1979 | Shields | 175/374 |
| 4,199,039 | 4/1980 | Thompson | 175/410 |
| 4,277,106 | 7/1981 | Sahley | 299/79 |
| 4,307,984 | 12/1981 | Patterson | 407/118 |

FOREIGN PATENT DOCUMENTS

| | | | |
|---|---|---|---|
| 2610734 | 9/1977 | Fed. Rep. of Germany | 175/410 |
| 2849711 | 6/1979 | Fed. Rep. of Germany | 175/410 |
| 632497 | 11/1978 | U.S.S.R. | 407/119 |
| 757701 | 8/1980 | U.S.S.R. | 299/86 |

*Primary Examiner*—William F. Pate, III

*Attorney, Agent, or Firm*—Robert E. Walter

[57] ABSTRACT

A rotatable cutting insert of the type having a shank depending from a head portion and having a hard insert mounted therein, includes an improved insert comprising a heat conducting base section disposed within a cavity in an intermediate section.

4 Claims, 3 Drawing Figures

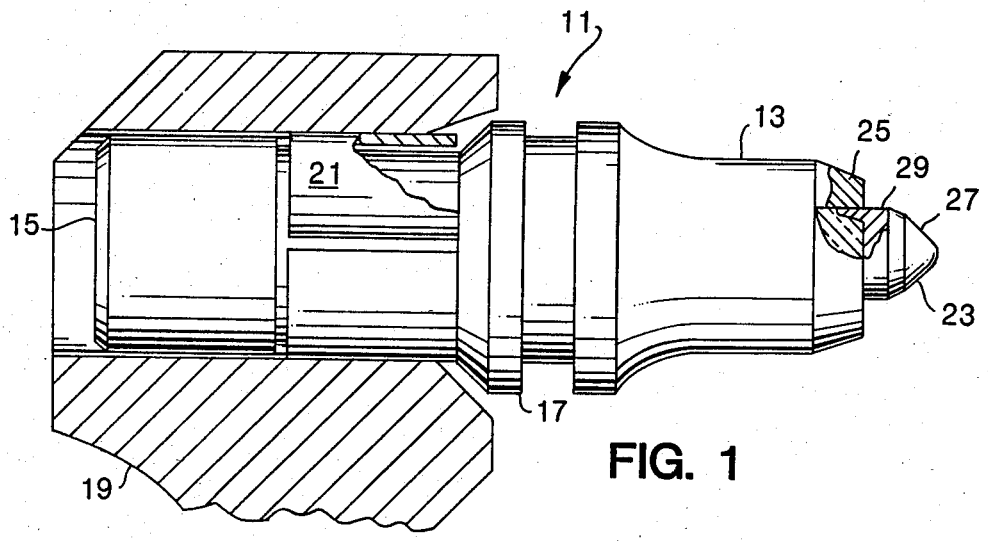
FIG. 1
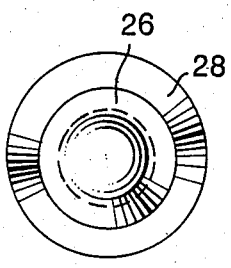
FIG. 3
FIG. 2
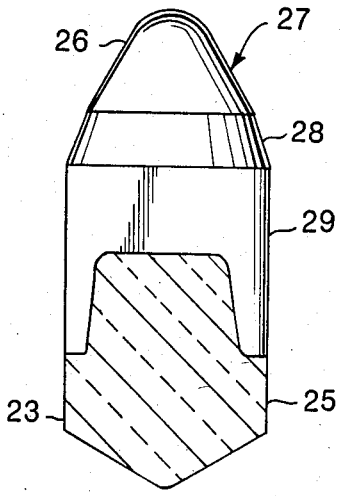

ROTATABLE CUTTING BIT

FIELD OF INVENTION

The present invention relates to a rotatable cutting bit of the type having a head portion and depending shank.

BACKGROUND OF INVENTION

Bits that are used in mining and for removing road surfaces are typically mounted in a machine having a power driven cutter wheel. The wheel has an array of cutter bits mounted on the rim which attack the material to be broken.

It is desirable to have the bits rotate in their sockets to permit wear on the bit to be distributed evenly so as to maintain sharpness.

SUMMARY OF INVENTION

In accordance with the present invention there is provided, a rotatable cutting bit comprising a head portion, a shank portion depending from said head portion along a longitudinal axis, said head portion having a socket at the foward end, a hard insert having coaxially aligned and integral sections, said sections comprising a nose section, a base section and an intermediate section contiguous said base and said nose section, said intermediate section having a cavity at the rearward end, said base section comprising a material of greater thermal conductivity than said intermediate section, a portion of said base being disposed in said cavity and another portion exiting rearwardly in said socket for conducting heat away from the insert.

To reduce heat build up within tungsten carbide tips in mining bits, a third component is added to the head assembly to draw away the heat. Drawing off the heat will help prolong the life of mining bit by reducing carbide wear.

Prior to this invention, no additional internal components were added to the system to draw away the heat. The steel surrounding the tip was the only mechanism for heat transfer.

This invention will help to draw away heat from the tip which builds up during the cutting operation. Tungsten carbide will wear longer if its operating temperature can be reduced.

DRAWINGS

FIG. 1 is a partially sectioned view of a bit mounted in block.

FIG. 2 is a side view of a tip; and

FIG. 3 is an end view of a tip.

DETAILED DESCRIPTION

Referreing to the drawings, FIG. 1 shows a rotatable bit 11 having a head portion 13 and a depending shank portion 15. The head portion 13 and shank 15 are coaxially aligned with the head 13 having an enlarged section 17 which prevents the head 13 from being forced into the opening in the mounting block 19. The shank portion 15 which is of cylindrical configuration includes a sleeve 21 which is radially contracted when present in the opening so as to hold the bit 11 in the block 19.

A hard insert 23 typically made of a carbide material is fixedly secured to the forward end of the head 13. Preferably the base section 25 of the insert 23 is positioned in the socket and brazed in place.

In accordance with the principles of the present invention, the insert 23 includes a plurality of sections coaxially aligned with the head 13 and shank 15 of the bit 11. The sections include a base section 25, a nose section 27 and an intermediate section 29 contiguous to the base 25 and nose section 27.

The base section 25 which is made of a heat conducting metal such as nickel or copper alloys includes a forward portion disposed in the cavity and a rearward portion extending rearward of the cavity. The rearward portion which is disposed in the socket of head conducts heat from the nose section 27 to the head 13. Preferably, a minor portion of the intermediate section 25 is disposed in the socket while the entire base section 35 is disposed therein. The base 25 typically used acts as a good conductor of heat.

I claim:

1. A rotatable cutting bit comprising a head portion, a shank portion depending from said head portion along a longitudinal axis, said head portion having a socket at the forward end, a hard insert having coaxially aligned an integral sections, said sections comprising a nose section, a base section, and an intermediate section contiguous said base and said nose section, said intermediate section having a cavity at the rearward end, said base section comprising a material of greater thermal conductivity than said intermediate section, a portion of said base being disposed in said cavity and another portion exiting rearwardly in said socket for conducting heat away from the insert.

2. A rotatable cutting bit according to claim 1 wherein said base portion is entirely disposed in said socket and at least a portion of said intermediate section is disposed in said socket.

3. A rotatable cutting bit according to claim 2 wherein said base includes a forward portion disposed in said cavity and a rearward section projecting rearward at said cavity.

4. A rotatable cutting bit according to claim 3 wherein said insert is fixedly held to said head portion by brazing.

* * * * *